US005473307A

United States Patent [19]

Lam

[11] Patent Number: 5,473,307

[45] Date of Patent: Dec. 5, 1995

[54] TRANSDUCER APPARATUS RESPONSIVE TO EXTERNAL PERTURBATION

[76] Inventor: Peter A. Lam, 20104 Wayne Ave., Torrance, Calif. 90503

[21] Appl. No.: 405,584

[22] Filed: Mar. 17, 1995

Related U.S. Application Data

[62] Division of Ser. No. 999,291, Dec. 31, 1992.

[51] Int. Cl.[6] ..... G08B 3/00

[52] U.S. Cl. ..... 340/467; 340/392.4; 340/392.5; 340/395.1; 340/692; 340/429; 340/689; 340/392.1; 200/61.45 R; 200/61.52; 200/52 A; 362/806

[58] Field of Search ..... 340/467, 464, 340/429, 683, 392, 689, 691–693, 665, 566, 392.1, 392.4, 392.5, 395.1; 200/61.45 R, 61.52, 52 A; 362/253, 806; 84/404, 464 R

[56] References Cited

U.S. PATENT DOCUMENTS

| | | | |
|---|---|---|---|
| 3,562,706 | 2/1971 | Mason | 340/429 |
| 3,601,564 | 8/1971 | Ellison | 340/467 |
| 4,155,067 | 5/1979 | Gleeson | 340/429 |
| 4,288,777 | 9/1981 | Luik | 340/932.2 |
| 4,381,504 | 4/1983 | Bitko | 340/683 |
| 4,385,288 | 5/1983 | Bitko | 340/693 |
| 4,679,033 | 7/1987 | Hwang | 340/566 |
| 4,805,511 | 2/1989 | Schwartz | 84/1.22 |
| 4,854,214 | 8/1989 | Lowe | 84/404 |
| 4,945,347 | 7/1990 | Perry | 340/689 |
| 5,072,208 | 12/1991 | Christensen | 340/392 |

OTHER PUBLICATIONS

"New! Electronic Wind Chimes", p. 139, Radio Shack, 1993 Catalog, Sep. 1992.

*Primary Examiner*—Donnie L. Crosland
*Attorney, Agent, or Firm*—Freilich Hornbaker Rosen

[57] ABSTRACT

Transducer apparatus (10) responsive to external perturbations is disclosed having an electrically responsive transducer circuit (12) energized when a display member (18) and an elongate member (20) move from a gravity determined quiescent orientation (30A) therebetween to an external perturbation driven activate orientation (30B) therebetween. In various embodiments, the members are respectively responsive to air movement and acceleration. In one embodiment, the elongate member carries a first electrical contact (21) to abut a second electrical contact (22) carried by the display member.

8 Claims, 7 Drawing Sheets

TRANSDUCER APPARATUS RESPONSIVE TO EXTERNAL PERTURBATION

RELATED APPLICATIONS

This is a divisional of U.S. patent application Ser. No. 07/999,291 filed Dec. 31, 1992, which is incorporated herein by reference.

FIELD OF THE INVENTION

The present invention relates to apparatus for energizing an electrically responsive transducer in response to external perturbations, e.g., air movement and/or acceleration, to produce an output comprised of sound and/or light and/or motion and/or heat.

BACKGROUND OF THE INVENTION

The use of conventional wind chimes to produce pleasing sounds in response to air movement is very well known. Although such wind chimes exist in many different structural configurations, they typically include one or more suspended vanes. In response to sufficient air motion, the vanes collide against one another and/or against a proximate housing, and produce sound determined primarily by the natural frequency of the colliding members.

SUMMARY OF THE INVENTION

The present invention is directed to an apparatus for producing an electrically generated output, e.g., sound and/or light and/or motion and/or heat, in response to external perturbations such as surrounding air motion and/or acceleration of a supporting member.

Embodiments of the invention are particularly suited for use, for example, in place of conventional wind chimes, to electronically simulate traditional wind chime sounds, but with the added advantage of being able to tailor the characteristics of the sound, e.g. Volume, duration, pitch, etc. Embodiments of the invention can also provide light and motion displays instead of, or to augment the sound display.

Additionally, embodiments of the invention find utility in many other applications, e.g., in automobiles, to provide an electrically generated output, e.g., pleasing sounds for the car's occupants in response to vehicle acceleration.

Embodiments of the invention are characterized by at least one elongate member mounted for movement relative to a display member, in response to an external perturbation, between a stable quiescent orientation and an unstable activate orientation to energize an electrically responsive transducer.

In accordance with a feature of the preferred embodiments, the elongate member carries a first electrically conductive member mounted so as to contact a second conductive member when the elongate member and display member move to their activate orientation to energize the transducer.

In one preferred embodiment, the elongate member comprises an air motion sensitive member while in another preferred embodiment it comprises a weighted bob. In another preferred embodiment, the elongate member is suspended from an external support to allow the display member to move relative thereto in response to acceleration. Thus, in these preferred embodiments, the external perturbations of air movement and/or acceleration will move the members to the activate orientation.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
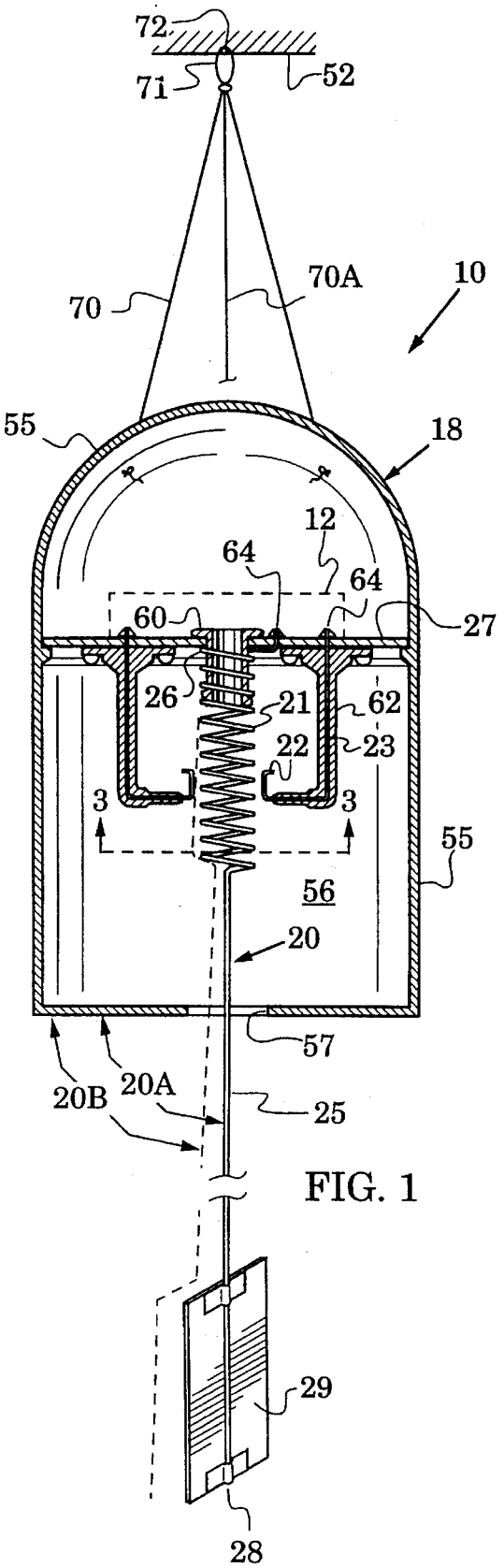
FIG. 1 is a sectional elevation view of a first embodiment of the present invention.

A preferred embodiment 10, in accordance with the present invention, of a transducer apparatus responsive to external perturbation is illustrated in the elevation view of FIG. 1. The apparatus 10 includes an electrically responsive transducer circuit 12 (indicated by broken lines and illustrated in FIG. 8) carried by a display member 18. The transducer circuit 12 is energized by completion of an electrical path when an elongate member 20 swings, relative to the display member 18, from a stable substantially vertical quiescent orientation 20A to an unstable activate orientation 20B.

The completion of the electrical path due to the display member 18 and elongate member 20 changing to the activate orientation 20B may be implemented in many different ways. For example, a proximity switch, an energy beam (e.g. visible or infrared light), or electrical contacts can be positioned to sense change between orientations 20A, 20B.

FIG. 1 illustrates an embodiment 10 in which a first electrical contact in the form of a flexible conductive helical member 21 and a second electrical contact in the form of ends of a plurality of conductive wires 23 are caused to engage when the display member and elongate member 20 are in the activate orientation 20B. In this embodiment, the helical member 21 and a descending extender portion 25 thereof are part of the elongate member 20 which is attached at a first end 26 to a mounting member 27 for swingable movement of a second end 28.

In the embodiment 10, the elongate member 20 includes, proximate to its second end 28, an air motion sensitive member in the form of a vane 29. Thus, an external perturbation, e.g., air movement, moves the elongate member 20 to complete an electrical circuit through the first and second electrical contacts 21, 22 to energize the transducer circuit 12.

Figure 2A:
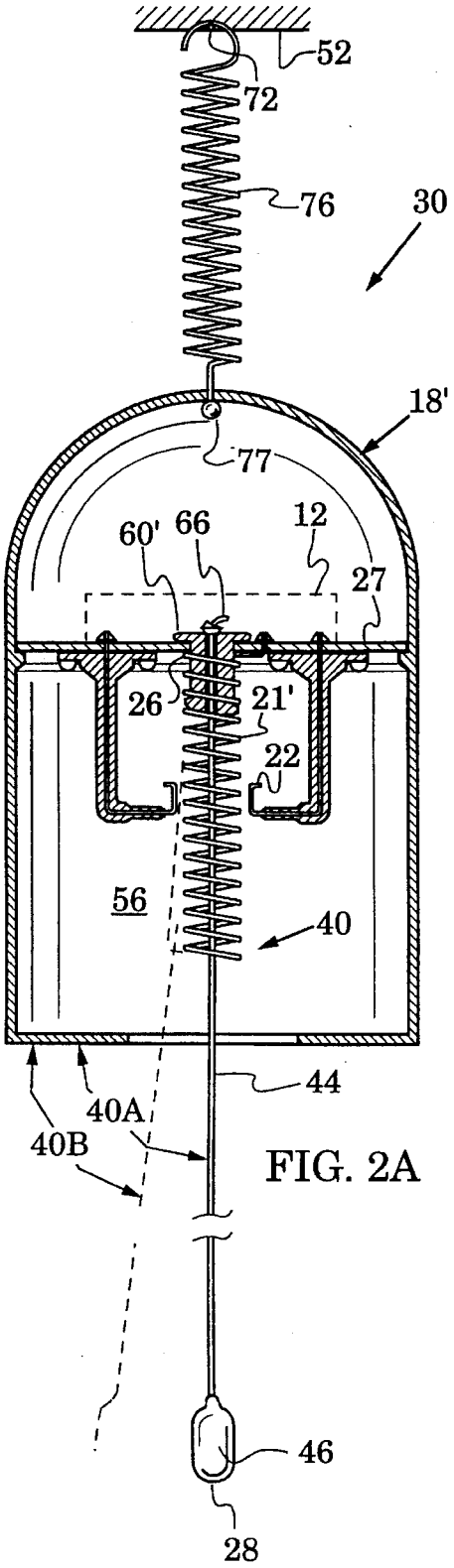
FIG. 2A is a sectional elevation view of another embodiment of the invention.

FIG. 2A is a view similar to FIG. 1 illustrating another preferred embodiment 30. In the embodiment 30, an elongate member 40 has a first electrical contact in the form of a flexible helical member 21', a flexible cord 44 received therethrough and, proximate to its second end 28, an acceleration sensitive member in the form of a weight or bob 46. Thus the external perturbation of acceleration may move the elongate member 40, relative to the display member 18', from a stable quiescent orientation 40A to an unstable activate orientation 40B. This completes an electrical circuit through the first and second electrical contacts 21, 22.

Figure 2B:
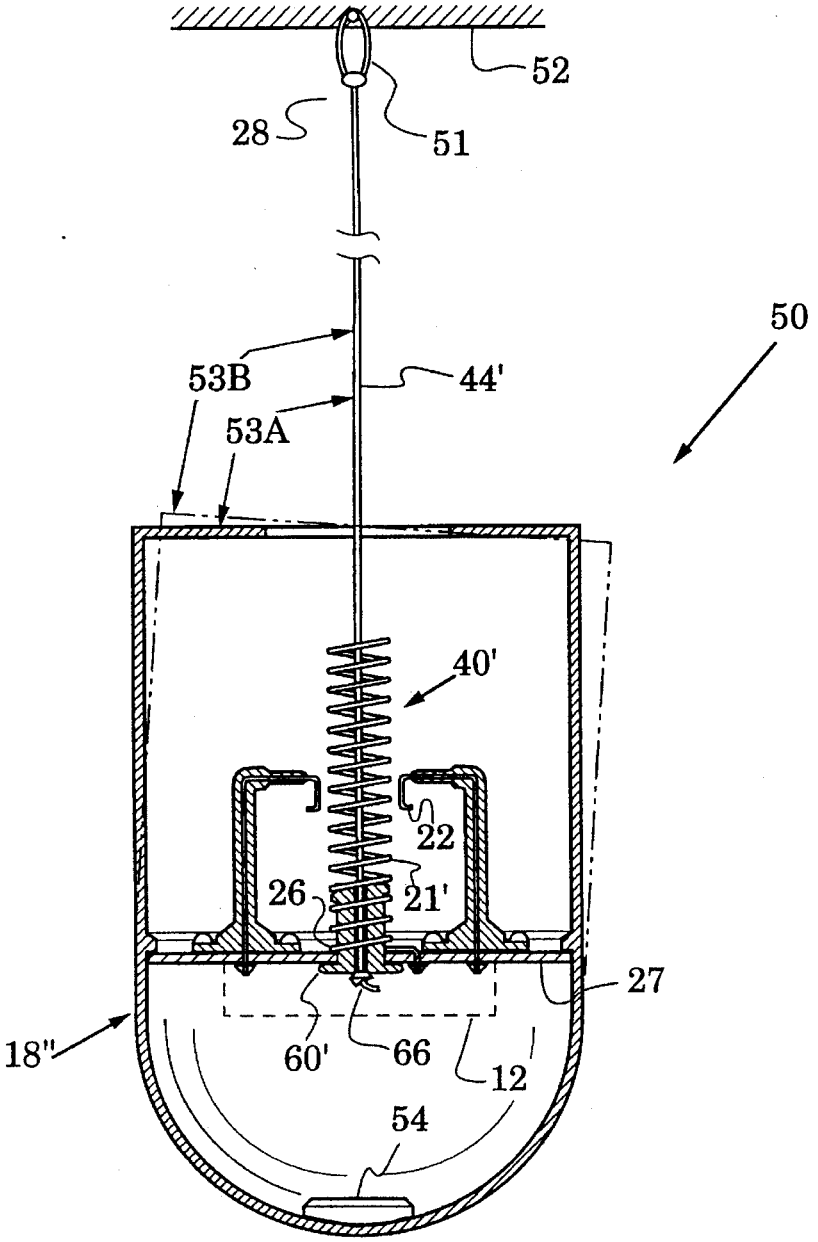
FIG. 2B is a sectional elevation view of another embodiment of the invention.

FIG. 2B illustrates another preferred embodiment 50. In the embodiment 50, an elongate member 40' has a first electrical contact in the form of a flexible helical member 21' and a flexible cord 44' received therethrough. A display member 18" is swingably supported from a first end 26 of the elongate member. The second end 28 of the elongate member 40' is suspended via a ring 51 to an external support 52. Therefore, the external perturbation of acceleration may move the display member 18", relative to the elongate member 40', from a stable quiescent orientation 53A to an unstable activate orientation 53B. The stability of the orientation 53A is maintained by forming the display member with a center of gravity lower than the elongate member first end 26. This may be done, for example, by adding a weight 54 to the lower part of the display member 18".

In apparatus embodiments 10, 30 and 50, the first and second electrical contacts 21, 22 are connected in series via a printed circuit, carried by the mounting member 27, with the electrically responsive transducer circuit 12. In embodiments 10 and 30, the respective display member 18, 18' is suspended from an external support member 52. The wall 55 of the display member 50 defines an internal space 56 and an aperture 57 which is dimensioned to clear the elongate member.

In the embodiment 10, the elongate member 20 has a vane 29 carried by an integral extender 20 and helical member 21. In the embodiments 30 and 50, and the elongate members comprise a helical member responsive to a flexible cord. It should be understood that these elongate member embodiments are exemplary. For example, in other embodiments of the invention an acceleration sensitive member could be combined with an integral extender and helical member while an air motion sensitive member could be combined with a helical member responsive to an elongate element received therethrough. Additionally, it should be understood that stiffer members (e.g. a wire) could be substituted for the cords 44, 44' of embodiments 30, 50.

The transducer circuit 12 mounted within the display member includes sound and/or light and/or motion and/or heat transducers depending on the particular application. For example, for a wind chime application, the transducer circuit 12 would include a sound transducer or speaker. In a decorative display application, the output transducer could comprise one or more light sources, e.g., light emitting diodes, or a small motor to create various visual effects. In a still further application, the output transducer could comprise a heating element useful, for example, to dispense an aromatic vapor, i.e., perfume. When the light and/or motion transducers are used, at least the upper portion or the wall 55 (in FIG. 1) is preferably formed of a transparent or translucent material (e.g. a polymer) to facilitate observation thereof.

It should be apparent from FIGS. 1, 2A and 2B that the embodiments 10, 30 and 50 are configured so that the respective stable quiescent orientations 20A, 40A and 53A are gravity determined while the respective unstable activate orientations 20B, 40B and 53B are determined by external perturbations. Embodiments of the invention are, therefore, suitable for initiating and presenting a display comprising sound and/or light and/or motion in any environment that provides air motion (e.g. a porch open to the wind, a fan), acceleration of the external support member 52 (e.g. the dashboard of an automobile) or other external perturbation.

Attention is now directed to additional details of FIGS. 1, 2A and 2B. In the embodiments 10, 30 and 50, the helical members 21, 21' are respectively received over insulating spools 60, 60' attached to the mounting member 27. Although the shape of the helical members 21, 21' lend a natural resistance to metal fatigue induced by repeated movement of the elongate members 20, 40 and 40' between the quiescent and activate orientations, the members 21, 21' are preferably formed of a soft metal to further enhance such resistance. The spool 60' of FIGS. 2A, 2B defines a central tube to receive cords 44, 44' which are knotted at 66 for retention by the spool 60'.

As shown in FIG. 1, the conductive wires 23 are carried by supports 62 descending from the mounting member 27. The upper ends of the helical member 21 and wires 23 are soldered at 64 to the printed circuit of the mounting member 27. The display member 18 defines an annular ledge 68 to retain the mounting member 27 thereto (the ledge 68 may be locally relieved for installation of the member 27).

In the embodiment 10, a plurality of flexible lines 70 terminating in an attachment member 71 (e.g. a loop, a hook) are externally secured radially to the wall 55 (e.g. knotted on the inner side thereof) for suspending the display member 18 from a projection 72 secured to the supporting member 52 (the line 70A terminates above the upper wall 55 because of the sectional view of FIG. 1). In the embodiment 30, a spring 76 which may enhance the gravity response of the bob 46, replaces the plurality of lines 70 with the aid of a restraining ball 77. In the embodiment 50, a ring 51 is used to suspend the elongate member second end 18 from the external support member 52

The supporting member 52 can form part of an immovable structure, e.g. a house beam, or alternatively, can comprise part of a movable structure such as an automobile roof. The plurality of radially attached lines 70 facilitates vertical alignment of the housing 50 from the supporting member 52.

Figure 3:
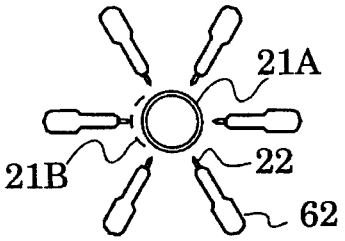
FIG. 3 is a view along the plane 3—3 of FIG. 1.

FIG. 3 is a view along the plane 3—3 of FIG. 1 illustrating how the form of the helical member (first electrical contact) 21 facilitates radial spacing therefrom of the plurality of second electrical contacts 22. When the helical member swings from the quiescent orientation 21A to the activate orientation 21B it will abut one or more second electrical contacts 22.

Figure 4A:
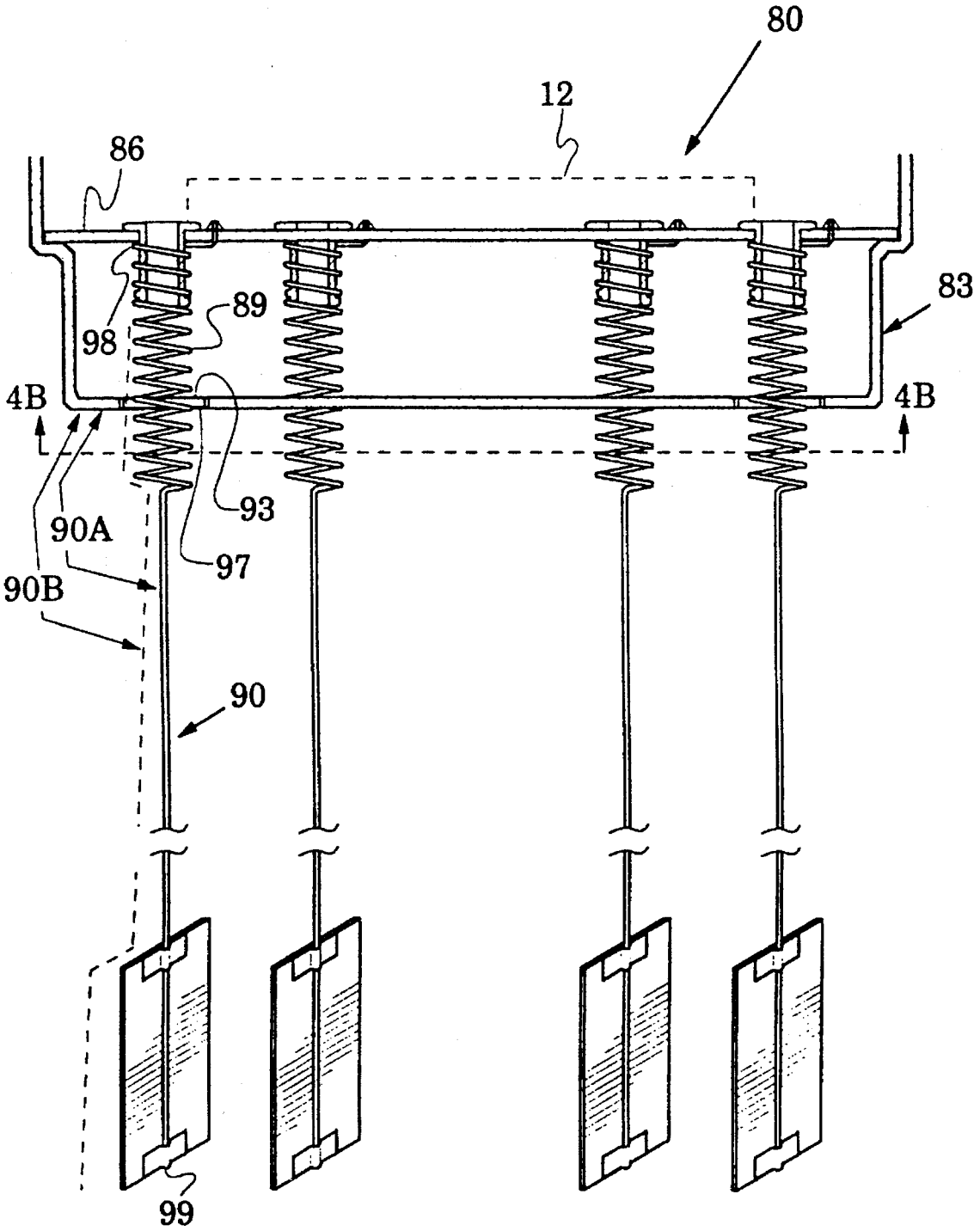
FIG. 4A is a sectional elevation view of another embodiment of the invention.
Figure 4B:
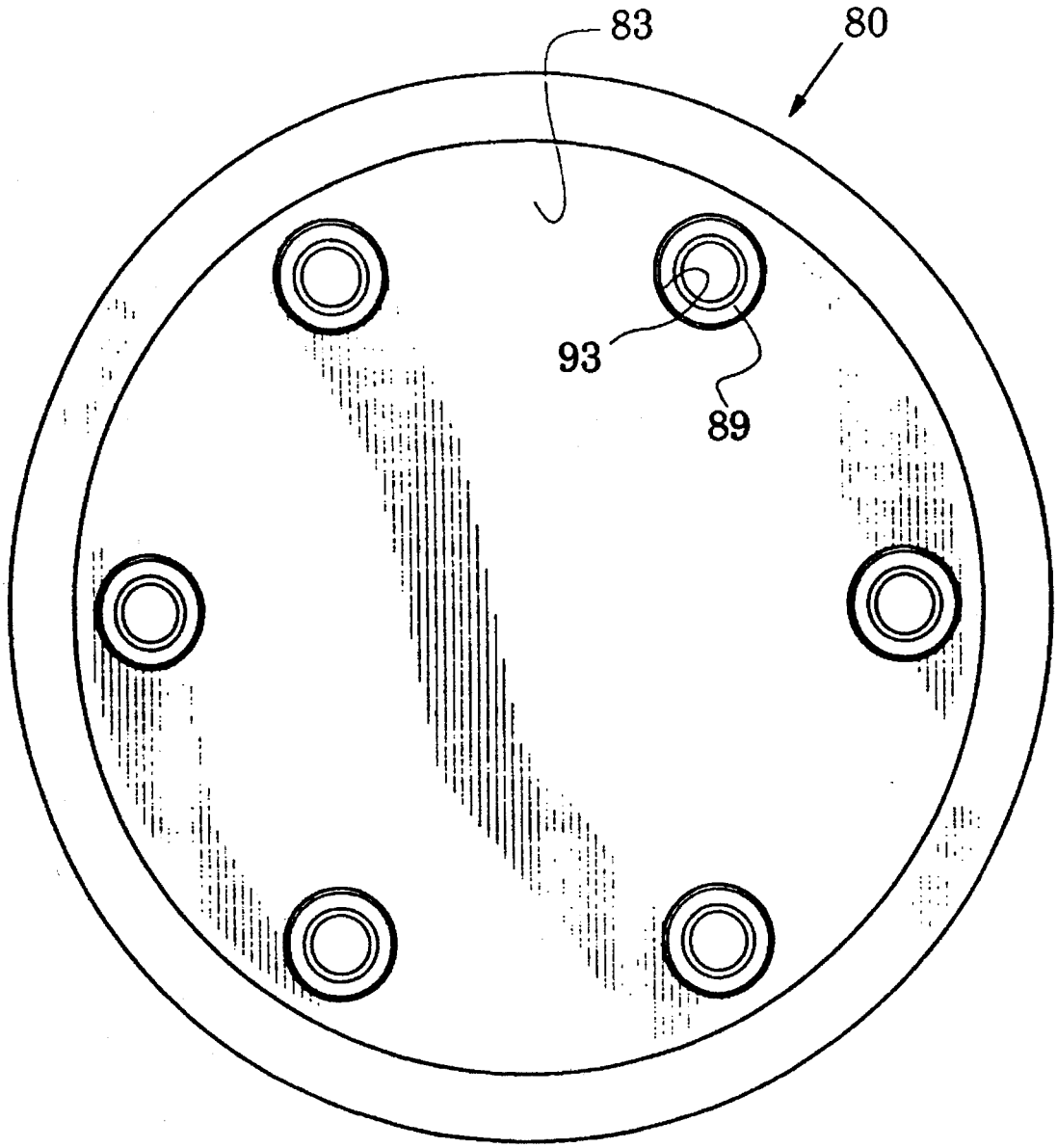
FIG. 4B is a view along the plane 4B—4B of FIG. 4A.

Attention is now directed to FIG. 4A which illustrates another preferred apparatus embodiment 80 having a display member 83 supporting a mounting member 86. In the apparatus 80, a plurality of elongate members 90 (similar to the elongate member 20 shown in FIG. 1) each define a first electrical contact in the form of a helical member 89. A plurality of second electrical connectors in the form of annular rings 93 line openings 97 defined by the display member 83. Each of the elongate members 90 are attached at a first end 98 to the mounting member 86 for swingable movement, relative to the display member 83, of a second end 99 from a substantially vertical gravity determined quiescent orientation 90A to an external perturbation driven activate orientation 90B. This structure is further illustrated in FIG. 4B which is a view along the plane 4B—4B of FIG. 4A.

The embodiment 80 provides structure, therefore, to activate the transducer circuit 12, via any first electrical contact 89 and its associated second contact 93, with a plurality of elongate members 90 each responsive to movement of air. Alternatively, the transducer circuit 12 may comprise a plurality of transducers each activated by a different first and second electrical contact pair.

Figure 5:
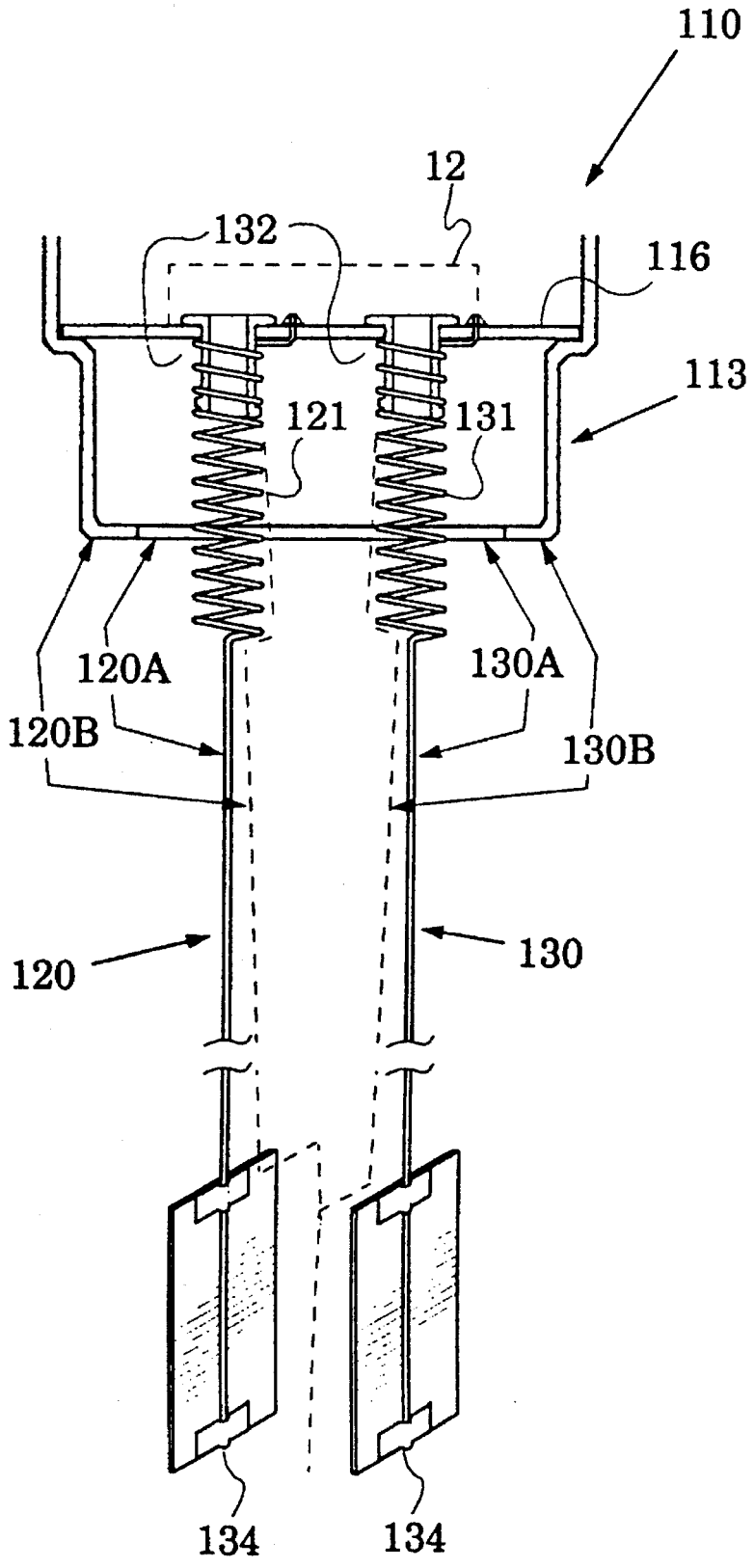
FIG. 5 is a sectional elevation view of another embodiment of the invention.

FIG. 5 illustrates another preferred apparatus embodiment 110 having a display member 113 supporting a mounting member 116. In the apparatus 110, a conductive elongate member 120 (similar to the elongate member 20 shown in FIG. 1) having a helical member 121 forms a first electrical contact. Another elongate member 130 having a helical member 131 forms a second electrical contact. The elongate members 120, 130 are attached at a first end 132 to the mounting member 116 for swingable movement, relative to the display member 113, of a second end 134 from, respectively, quiescent orientations 120A, 130A to external perturbation driven activate orientations 120B, 130B which complete an electrical path through the transducer circuit 12. The embodiment 110 provides structure, therefore, to activate the transducer circuit 12 via contact between first and second electrical contacts formed by elongate members 120, 130.

Figure 6:
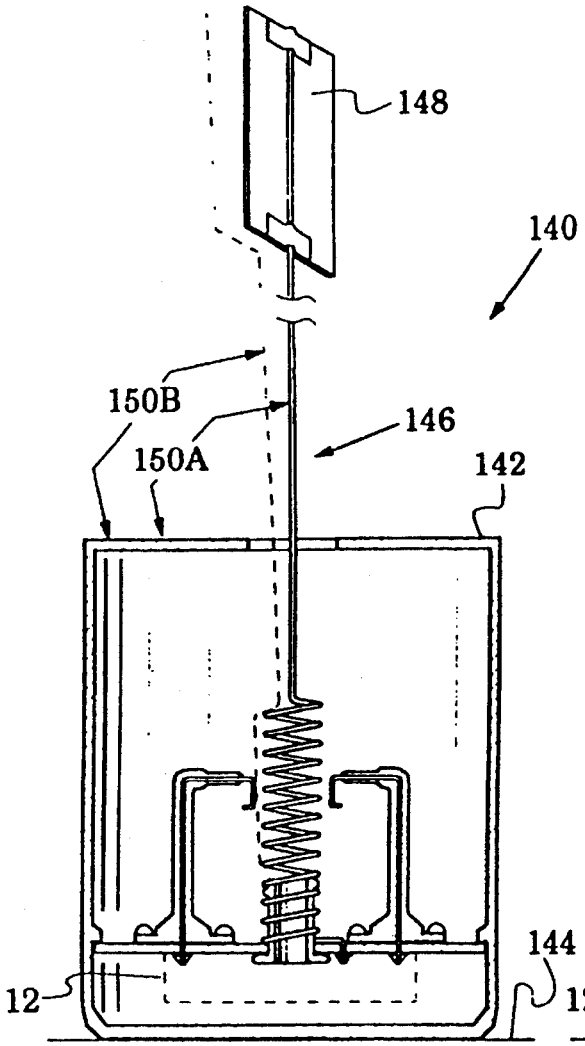
FIG. 6 is a sectional elevation view of another embodiment of the invention.

Another apparatus embodiment 140 is shown in FIG. 6. The embodiment 140 is similar to an inverted form of the embodiment 10 of FIG. 1. The display member 142 is configured to rest on a base 144 and the elongate member 146 includes a vane 148 to respond to air movement so that the relative orientation of the members 142, 146 changes from the quiescent orientation 150A to the activate orientation 150B.

Figure 7:
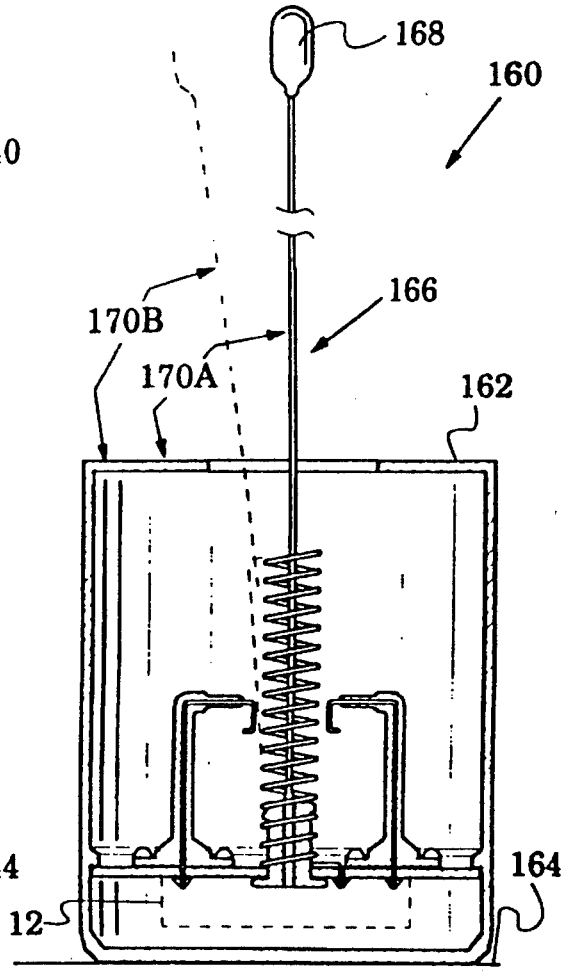
FIG. 7 is a sectional elevation view of another embodiment of the invention.

Another apparatus embodiment 160 is illustrated in FIG. 7 which is similar to an inverted form of the embodiment 30 of FIG. 2. The display member 162 is configured to rest on a base 164 and the elongate member 166 includes a bob 168 to respond to acceleration so that the relative orientation of the members 162, 166 changes from the quiescent orientation 170A to the activate orientation 170B.

Whereas the elongate members in the embodiments of FIGS. 1, 2A, 2B, 4A, 4B and 5 could be flaccid, the elongate members of FIGS. 6 and 7 must be sufficiently stiff so as to be free standing. Thus, a suitable elongate member could be formed of a material having appropriate spring characteristics to inherently establish its stable vertical orientation or could be formed of a rigid material which is spring mounted in a manner to establish its stable vertical orientation. It is also pointed out that in both FIGS. 6 and 7, the display members 142 and 162 are preferably secured to the base 144, 164 by a suitable means such as an adhesive or by Velcro.

Figure 8:
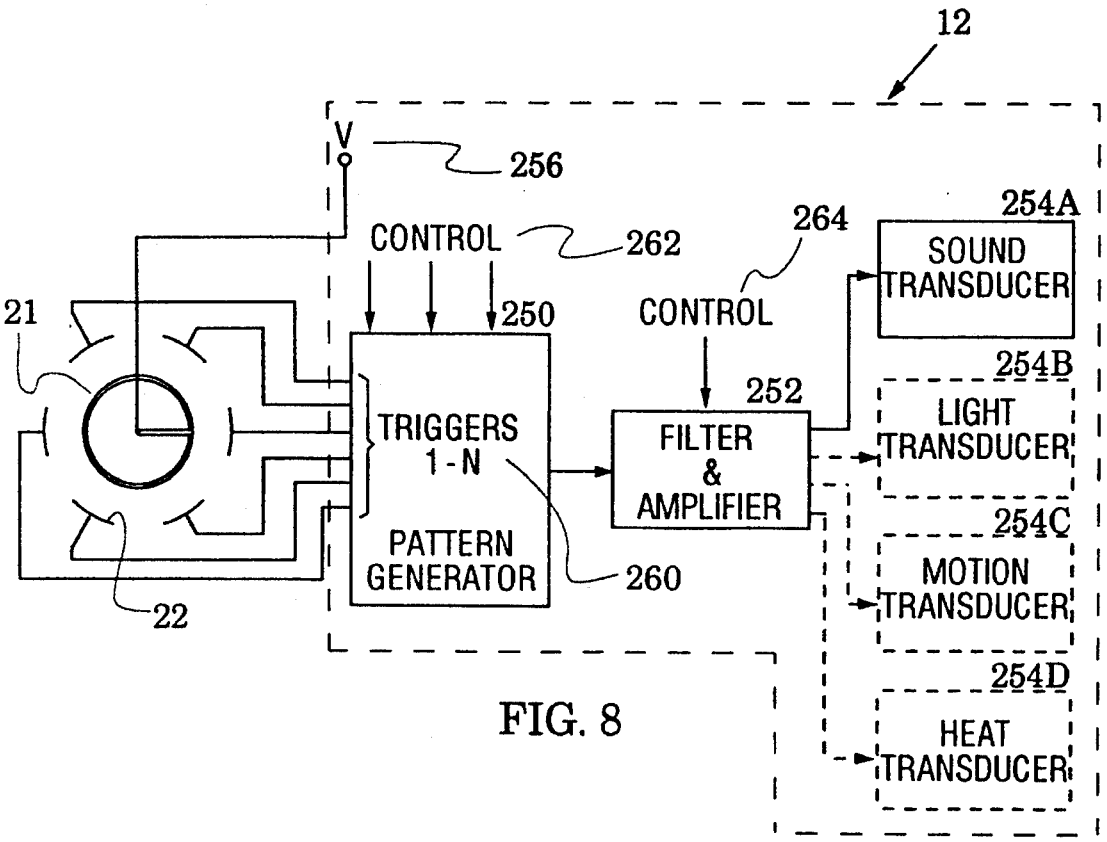
FIG. 8 is a circuit diagram of an embodiment of the invention.

FIG. 8 depicts a circuit diagram of the transducer circuit 12 which includes a pattern generator 250, a filter and amplifier 252 and a sound transducer 254A. Alternatively, the circuit 12 may include a light transducer 254B and/or a motion transducer 254C and/or a heat transducer 254D. The first and second electrical contacts 21, 22 (shown for example in FIG. 1) are connected in series with the transducer circuit circuit 12. When the elongate member and display member are in their activate orientation (e.g. members 18, 20 of FIG. 1) are in their quiescent orientation, the first and second electrical contacts 21, 22 will be spaced from one another as shown in FIG. 8. When they move to the activate orientation, the first and second electrical contacts 21, 22 will move into electrical contact to energize the transducer circuit 12 by completing an electrical circuit through it (e.g. by connecting the voltage supply 256 to the remainder of the circuitry).

Various commercially available pattern generators are known for producing signals for driving the transducers 254 to produce desired outputs. For example, inexpensive semiconductor chips (e.g. presently used in greeting cards and toys) can be used as the pattern generator 200. Such chips are readily capable of producing different electrical patterns for driving the transducers 254. Each pattern can be activated when the circuit is completed through a different trigger input 260.

When the sound transducer 254A (e.g. a speaker) is used, the transducer circuit 12 may synthesize and emit various sounds which simulate chimes, wind, ocean waves, etc. These sounds may each be activated, for example, when the circuit is completed through a different one of the second electrical contacts 22. The transducer circuit 12 is preferably provided with various control inputs 262 which enable a user to control, for example, melody, tempo, duration, etc. Similarly, the filter and amplifier 252 is preferably provided with one or more controls 264 for enabling the user to control volume and pitch.

In operation, for example with the apparatus 20 mounted as shown in FIG. 1, an external perturbation will swing the elongate member 20 from the quiescent to the activate orientation to momentarily connect the first and second electrical contacts 21, 22. This momentary contact is sufficient to activate the pattern generator 250 to drive the sound transducer 254A in accordance with information preprogrammed into the pattern generator 50, as modified by the settings of the controls 260,262.

In contrast, for example, to a conventional wind chime apparatus in which the sound output depends upon the magnitude of the collision between elements, embodiments of the present invention can produce a sound output which is selectively related to or independent of the magnitude of the collision. As noted, the sound output depends upon the preprogramming of the pattern generator 250 as well as the controls 262, 264.

In a manner similar to that described above, the alternative light transducer 254B can display patterns of light produced by miniature light sources, the alternative motion transducer 254C can display motion produced by miniature electrical motors and the alternative heat transducer 254D can dispense an aromatic vapor.

The transducers 254, filter and amplifier 252 and pattern generator 250 can all be readily packaged on a small circuit board (e.g. printed circuit board defined by the mounting member 27 in FIG. 2) which can be easily accommodated as indicated within the broken line 12 in FIGS. 1, 2, 4, 5, 6 and 7.

Figure 9:
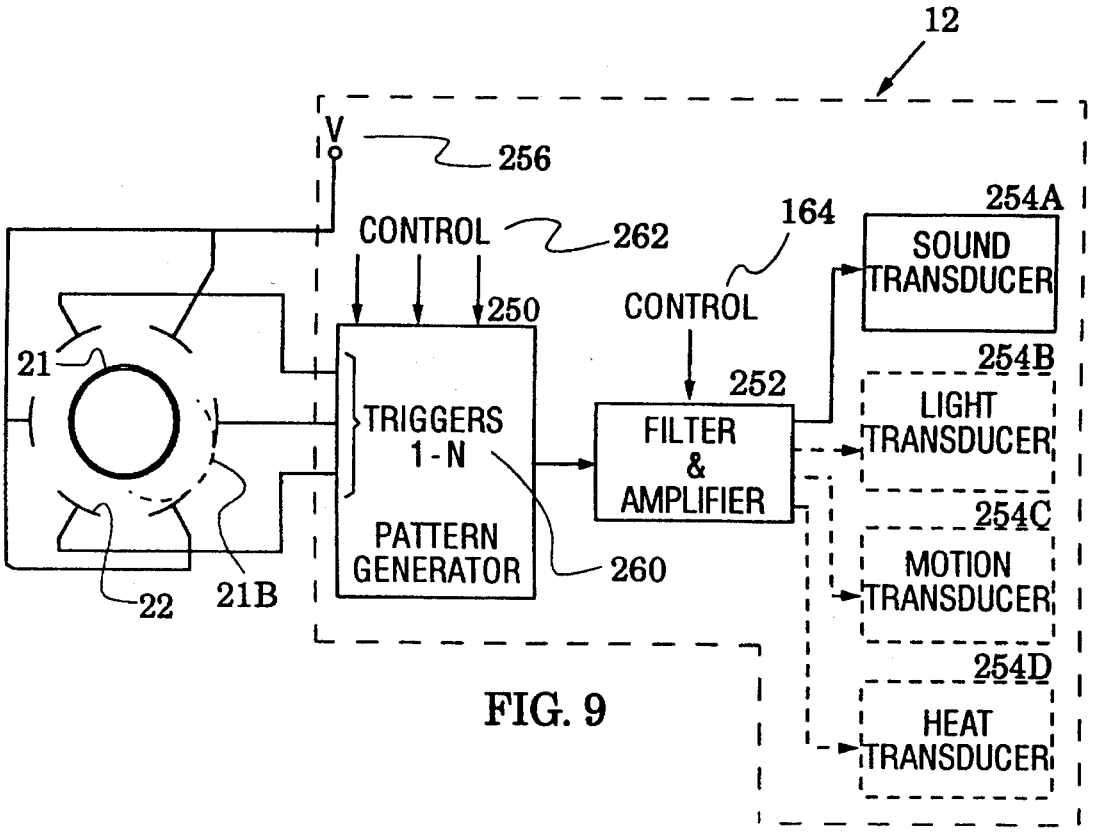
FIG. 9 is a circuit diagram of another embodiment of the invention.

FIG. 9 illustrates an alternate arrangement of the circuit diagram of FIG. 8 in which the circuit is completed by the first electrical contact 21 abutting pairs of second electrical contacts 22 as shown in the activate orientation 21B.

From the foregoing, it should be appreciated that transducer apparatus embodiments have been disclosed herein energizable in response to external perturbations such as wind or acceleration.

The preferred embodiments of the invention described herein are exemplary and numerous modifications, dimensional variations and rearrangements can be readily envisioned to achieve an equivalent result, all of which are intended to be embraced within the scope of the appended claims.

What is claimed is:

1. A display apparatus useful in combination with a vehicle for producing an audible sound in response to acceleration of said vehicle, said apparatus comprising:

a display member;

a mounting member;

means for securing said mounting member to said vehicle;

an elongate member;

means supporting said elongate member for relative movement with respect to said mounting member from a stable orientation to an unstable orientation in response to acceleration of said vehicle;

an electrically responsive sound transducer; and circuit means, responsive to relative movement of said members to said unstable orientation, for energizing said transducer to produce said audible sound.

2. An apparatus useful in combination with a vehicle for producing an audible sound in response to acceleration of said vehicle, said apparatus comprising:

a mounting member;

means for securing said mounting member to said vehicle;

an elongate member;

means supporting said elongate member for relative movement with respect to said mounting member from a stable orientation to an unstable orientation in response to acceleration of said vehicle;

an electrically responsive sound transducer; and an electronic pattern generator defining a predetermined signal pattern, said pattern generator being responsive to relative movement of said members to said unstable orientation for energizing said transducer to synthesize a sound defined by said signal pattern.

3. A motion responsive switch including:

an elongate member having first and second ends;

means suspending said elongate member first end from a mounting member for enabling said elongate member to move from a stable orientation to an unstable orientation in response to an external perturbation;

said elongate member including a resilient helical portion and a linear portion;

circuit means; and at least one electrically conductive member mounted proximate to the first end of said elongate member for energizing said circuit means when said elongate member moves to said unstable orientation.

4. The switch of claim 3 further including a perturbation responsive element carried by said elongate member proximate to said second end.

5. The switch of claim 3 wherein said helical portion is formed of electrically conductive material.

6. The switch of claim 3 wherein said linear portion extends axially through said helical portion.

7. The switch of claim 3 wherein said linear portion is formed integral with and extends from one end of said helical portion.

8. The switch of claim 3 wherein the spacing between said helical portion and said electrically conductive member determines the position of said unstable orientation.

* * * * *